US007958877B2

(12) United States Patent
Lalor

(10) Patent No.: US 7,958,877 B2
(45) Date of Patent: Jun. 14, 2011

(54) LAUNCHING SYSTEM FOR LAUNCHING TARGET AND RETRIEVAL DEVICES

(76) Inventor: Tom Lalor, North Vancouver (CA)

( * ) Notice: Subject to any disclaimer, the term of this patent is extended or adjusted under 35 U.S.C. 154(b) by 623 days.

(21) Appl. No.: 12/012,187

(22) Filed: Jan. 31, 2008

(65) Prior Publication Data

US 2009/0194085 A1 Aug. 6, 2009

(51) Int. Cl.
*F41F 7/00* (2006.01)

(52) U.S. Cl. ..... 124/8; 124/1; 124/16; 124/41.1; 124/51.1; 119/702; 119/707; 119/709

(58) Field of Classification Search ..... 124/1, 8, 124/16, 41.1, 51.1; 119/702, 707, 709
See application file for complete search history.

(56) References Cited

U.S. PATENT DOCUMENTS

| | | | | | |
|---|---|---|---|---|---|
| 2,989,045 | A * | 6/1961 | Hodge et al. | 124/47 |
| 3,130,717 | A * | 4/1964 | Moinil et al. | 124/1 |
| 3,621,828 | A * | 11/1971 | Hansen | 124/8 |
| 3,926,170 | A * | 12/1975 | Dixon | 124/8 |
| 3,937,203 | A * | 2/1976 | Riedmueller et al. | 124/8 |
| 3,951,125 | A * | 4/1976 | Dixon | 124/8 |
| 4,005,695 | A * | 2/1977 | Alday et al. | 124/8 |
| 4,048,976 | A * | 9/1977 | Alday et al. | 124/47 |
| 4,146,007 | A * | 3/1979 | Alday et al. | 124/9 |
| 4,146,008 | A * | 3/1979 | Rowlands | 124/43 |
| 4,481,932 | A * | 11/1984 | Olson | 124/8 |
| 4,706,641 | A * | 11/1987 | Cote et al. | 124/8 |
| 4,784,107 | A * | 11/1988 | Kelly | 124/61 |
| 4,967,720 | A * | 11/1990 | McCord et al. | 124/8 |
| 4,976,249 | A * | 12/1990 | Gagnon | 124/8 |
| 5,036,828 | A * | 8/1991 | Heffer | 124/47 |
| 5,050,575 | A * | 9/1991 | Killion | 124/8 |
| 5,140,971 | A * | 8/1992 | Heffer | 124/8 |
| 5,249,563 | A * | 10/1993 | Patenaude | 124/8 |
| 5,406,928 | A * | 4/1995 | Panara et al. | 124/8 |
| 5,605,139 | A * | 2/1997 | Orwoll | 124/8 |
| 5,704,341 | A * | 1/1998 | Ritzenthaler | 124/8 |
| 5,720,664 | A * | 2/1998 | Brubacher | 463/52 |
| 5,771,874 | A * | 6/1998 | Kohler | 124/8 |
| 5,871,003 | A * | 2/1999 | Laporte et al. | 124/9 |
| 5,937,839 | A * | 8/1999 | Nilsson et al. | 124/8 |
| 5,970,969 | A * | 10/1999 | Anttila et al. | 124/8 |
| 6,026,796 | A * | 2/2000 | LaPorte et al. | 124/7 |
| 6,062,207 | A * | 5/2000 | Underhill | 124/8 |
| 6,176,229 | B1 * | 1/2001 | Patenaude | 124/8 |
| 6,276,350 | B1 * | 8/2001 | Davey | 124/8 |
| 6,318,350 | B1 * | 11/2001 | Williams | 124/71 |
| 6,431,161 | B1 * | 8/2002 | Gustafsson | 124/8 |
| 6,505,577 | B1 * | 1/2003 | Putnam | 119/702 |
| 6,588,410 | B1 * | 7/2003 | Graber | 124/8 |
| 6,637,422 | B2 * | 10/2003 | Wojtkiewicz et al. | 124/78 |
| 6,708,649 | B1 * | 3/2004 | Lalor | 119/709 |
| 7,096,825 | B2 * | 8/2006 | Kim | 119/427 |
| 7,263,986 | B2 * | 9/2007 | Lovell | 124/9 |
| 7,637,255 | B1 * | 12/2009 | Freeland | 124/7 |
| 2006/0065258 | A1 * | 3/2006 | Lovell | 124/9 |
| 2008/0156307 | A1 * | 7/2008 | Myers | 124/20.1 |

* cited by examiner

*Primary Examiner* — Gene Kim
*Assistant Examiner* — Alexander R Niconovich
(74) *Attorney, Agent, or Firm* — Jeffrey S. Sokol; Sokol Law Office

(57) ABSTRACT

An apparatus is disclosed for launching targets, retrieval devices and combination target and retrieval devices, wherein the targets and retrieval devices may be irregularly shaped, such as like birds. Multiple targets are held on a carousel delivery system and eventually moved in a launching position by a push arm. A throwing arm is then rotated, pushing the target along a throwing guide until it reaches a launching position, at which point the target is released for use in shooting practice and/or training retrieving dogs.

26 Claims, 6 Drawing Sheets

LAUNCHING SYSTEM FOR LAUNCHING TARGET AND RETRIEVAL DEVICES

FIELD

The present invention relates to a reliable launching system. Specifically, the present launching system is for use in launching targets, retrieval devices (such as bumpers), and combination target and retrieval devices used for shooting practice and training retrieving dogs. The launching system described herein is particularly useful for launching targets and retrieval devices of an irregular shape, such as bird-shaped targets or bumpers, or special combination target and retrieval devices such as those described in U.S. Pat. No. 6,708,649, issued on Mar. 23, 2004 to Lalor, which is incorporated herein by reference.

BACKGROUND

There are a number of devices for launching targets and retrieval devices for the purpose of shooting practice or for dog training.

One such device described in U.S. Pat. No. 6,318,350, issued on Nov. 20, 2001 to Williams, uses a compressed air gun to launch mock birds, which are stored in a plurality of cylindrical housings. However, compressed air is notoriously unpredictable and the design of Williams does not allow for a large number of targets to be loaded on the device. Moreover, the use of a compressed air gun requires that the shape of the targets or retrieval devices used conform very closely to the shape of the housing in which they are stored.

U.S. Pat. No. 6,505,577, issued on Jan. 14, 2003 to Putnam describes a target launching device consisting essentially of a tripod and a pivot arm connected to a pneumatic cylinder, as well as a magazine consisting of a rectangular tube with a small opening. Putnam teaches that the targets be made from rubber cylinders having a string tied to a PVC washer at one extremity. This enables the targets to be loaded on the device by placing the PVC washer in the rectangular tube and the string in the opening, with the rubber cylinder hanging below. This design again limits not only the number of targets in the magazine, but also the appearance and shape of the target.

Accordingly, there is a need for a device capable of launching targets, retrieval devices and combination target and retrieval devices consistently and reliably, with the added capability of being able to launch irregularly shaped targets and retrieval devices and the capacity to load a large number of such devices for launching.

It should be understood that the launching system described herein by the applicant is capable of launching targets, retrieval devices (such as retrieval devices 90 shown in FIG. 6 herein) and special combination target and retrieval devices (such as combination target and retrieval devices 92 shown in FIG. 7 and described in U.S. Pat. No. 6,708,649, referred to above). For the sake of brevity, all such devices shall be referred to herein collectively as "targets" and those skilled in the art will understand that any reference to such "targets" will include a reference to retrieval devices and combination target and retrieval devices.

SUMMARY

The present launching system addresses the above problems by providing a throwing arm mechanism powered by a spring in a manner similar to many clay-type target launching systems. During use, the throwing arm rotates around a central axis and its distal end engages the target, which is resting at a launch position. Once engaged by the throwing arm, the target is accelerated by the distal end of the throwing arm, and remains engaged with the throwing arm due to the shape of the distal end of the throwing arm and a throwing guide consisting of a ramp whose inner surface defines essentially the movement of the distal end of the throwing arm from the launching position to the launch point. In one embodiment, the distance between the launching position and the launch point corresponds to less than approximately 120 degrees of rotation from the central axis, and preferably less than 90 degrees.

As the target is accelerated by the throwing arm, the target travels along the inner surface of the throwing guide, which may be made of a low friction material. Once the target reaches the end of the throwing guide, its own momentum propels it into the air. The angle at which the target is launched depends on the positioning of the launch point, and more specifically, the slope of the tangent of the inner surface of the throwing guide at the launch point.

The present launching system also comprises a delivery system, for holding a plurality of targets, and to successively load targets into the launching position. The delivery system may be a carousel comprised of a plurality of spokes radiating from a central hub, one of which is lined up with the launching position. The targets may have a hollow passage through their bodies which allows them to be skewered onto the spokes. Other methods of fastening the targets to the spokes may be used, such as a hook or a clip, however, by using a hole through the target, the target can be made to a more uniform shape, which allows for better manageability in loading and launching the target.

As one target is launched, the next one may be loaded into the launching position by a push arm. The push arm moves along a track radially outward from a point near the central hub to a point near the launching position, thereby sliding the target off the spoke lined up with the launching position into the launching position. In the event this spoke holds no more targets, the push arm activates a switch, thereby rotating the carousel and lining up another spoke with the launching position.

According to one aspect then, there is provided a launching system for launching targets, the launching system comprising: a delivery system for delivering the targets to a launching position, the delivery system comprising: at least one spoke for holding a plurality of the targets; means for placing at least one of the targets held on the at least one spoke into the launching position; and a throwing arm adapted to throw the at least one target from the launching position.

According to another aspect, there is provided a method of launching targets comprising the steps of: providing a launching system for launching the targets, the launching system comprising: a delivery system for delivering the targets to a launching position, the delivery system comprising: at least one spoke for holding a plurality of the targets; and means for placing at least one of the targets held on the at least one spoke into the launching position; and a throwing arm adapted to throw the at least one target from the launching position; activating the delivery system, thereby causing the at least one target to be moved into the launching position; and activating the throwing arm, thereby causing the at least one target to be launched.

According to another aspect, there is provided a target for use in a target launching system, the target launching system comprising a delivery system for delivering the target to a launching position, the delivery system comprising at least one spoke for holding the target, the target comprising: alignment means for hold and aligning the target on the at least one spoke. The alignment means may comprise a hole extending through a portion of the target, whereby the target may be held on the at least one spoke by running the at least one spoke through the alignment hole. Further, a cross-section of the alignment hole of the target may be a non-round shape.

It is to be understood that other aspects of the present launching system will become readily apparent to those skilled in the art from the following detailed description, wherein various embodiments are shown and described by way of illustration. As will be realized, the launching system is capable of other and different embodiments and its several details are capable of modification in various other respects, all without departing from the spirit and scope of the launching system described. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the launching system are illustrated by way of example, and not by way of limitation, in detail in the figures, wherein.

DETAILED DESCRIPTION

Figure 1:
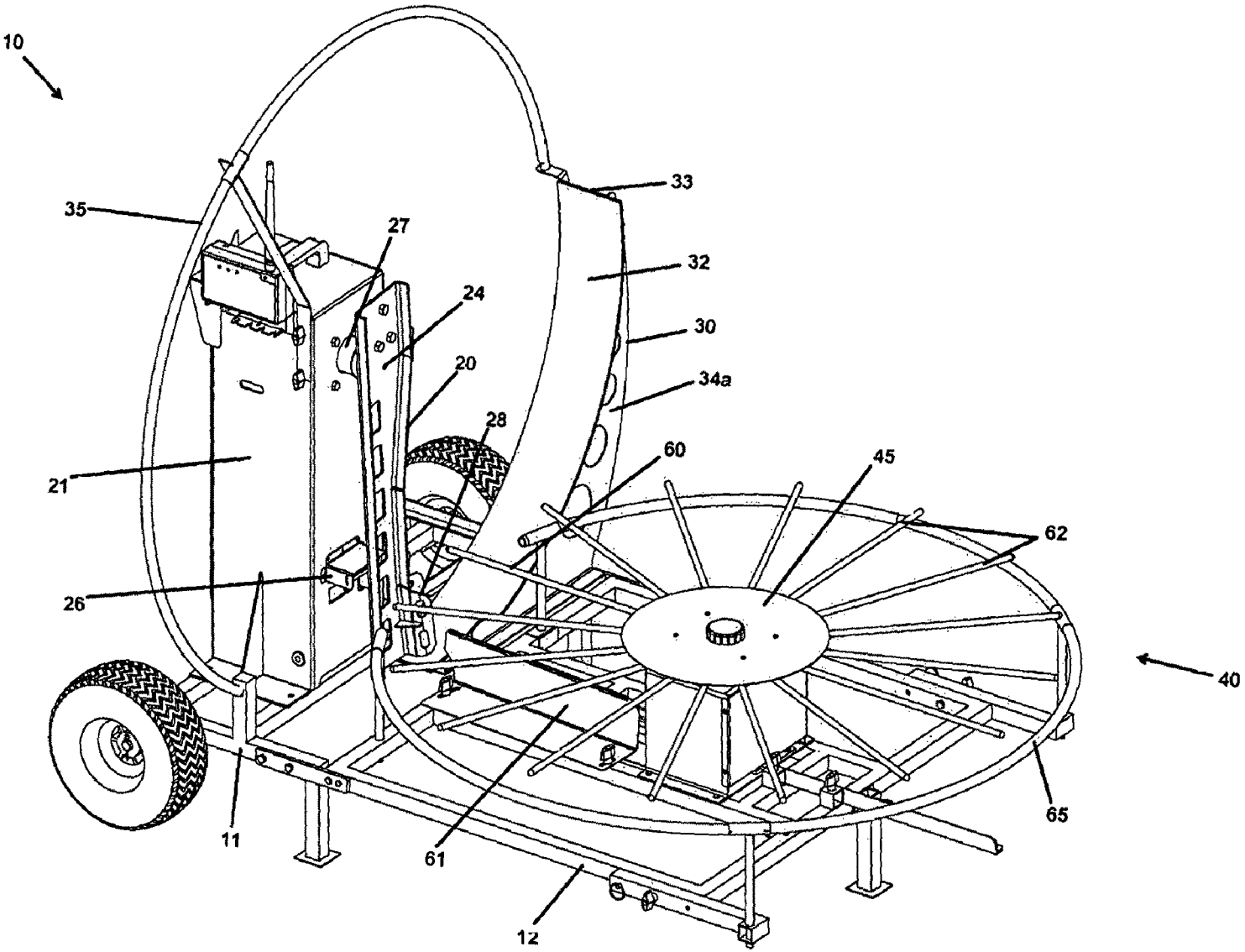
FIG. 1 is a front right-side perspective view of one embodiment of the applicant's target launching system.

The applicant's launching system will now be described with reference to specific embodiments. With reference to FIGS. 1 to 5, a launching system is generally indicated by the numeral 10. The system comprises a throwing arm 20, a throwing guide 30, and a target delivery system 40.

As shown, launching system 10 is supported by a main support frame 11 and a delivery system support frame 12, which may be constructed of welded aluminum or steel bars. The support frames 11, 12 may be made of any suitably strong material and constructed according to well-known engineering method and standards. Support frames 11 and 12 could be combined into a single frame if desired, however, the applicant has found that by using two separate frames the launching system is easier to disassemble and transport.

Figure 2:
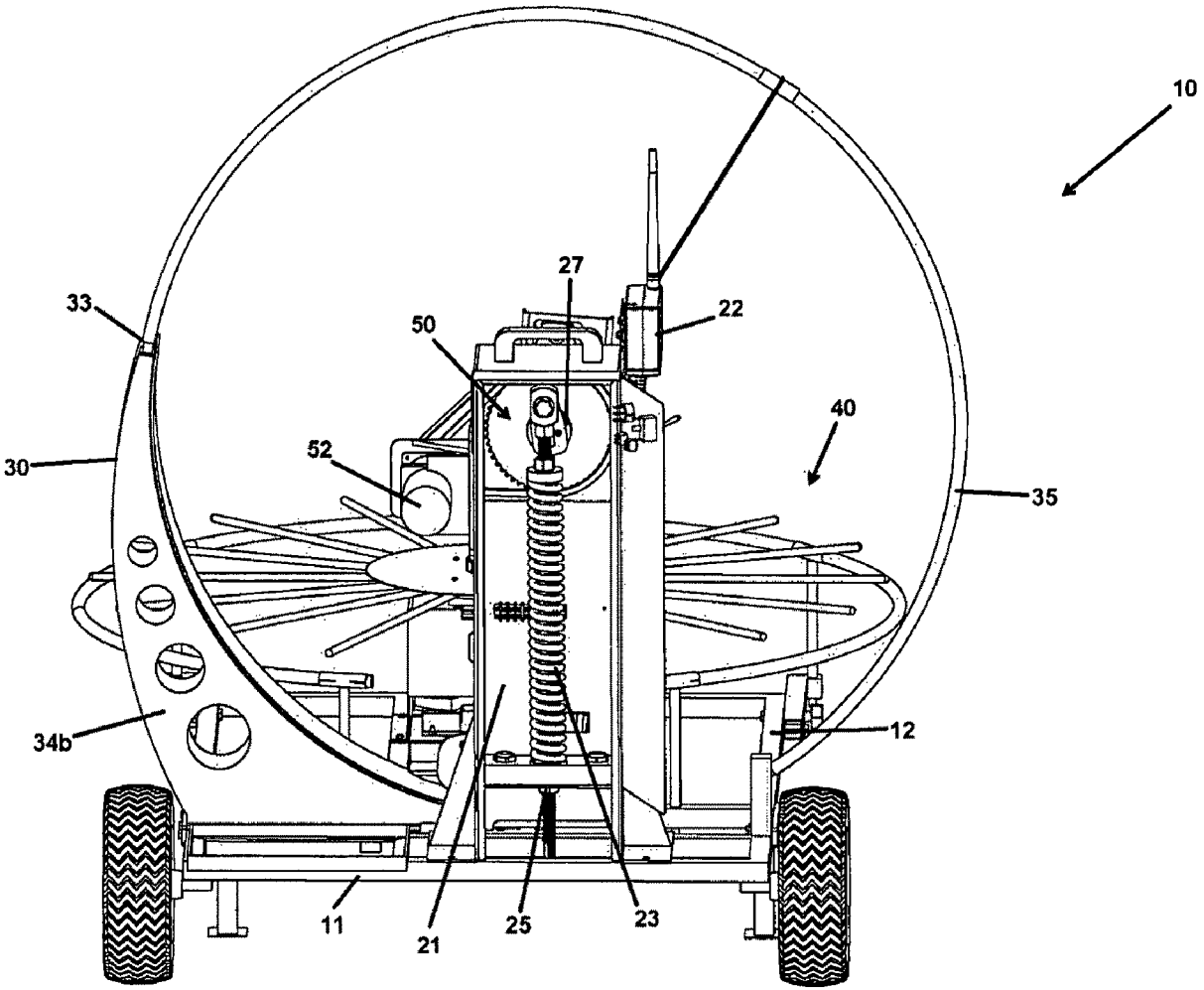
FIG. 2 is a rear view of the target launching system shown in FIG. 1.

Directly supported by main support frame 11 is a housing 21, which is best shown in FIG. 2 from the rear. Housing 21 contains a heavy-duty spring 23, connected at one end to anchor 25, and at the other end to a crank mechanism 50 powered by a crank motor 52. The system may also include a receiver 22 fixed to the housing, for receiving signals via wireless communication from a remote transmitter and sending control signals to the crank mechanism 50. The housing 21 also includes an opening for a driveshaft 27 and one-way bearing, which connects the crank mechanism 50 to the throwing arm 20, and a throwing arm stop sensor 26 for stopping the crank mechanism 50 when throwing arm 20 reaches a launching position 31 (see FIG. 4).

The driveshaft 27 is equipped with a one-way bearing. The crank mechanism 50 cranks the drive shaft one way against the force of spring 23 until a cam on the shaft is near a top "ready to fire" position. Once a launch signal is received by the receiver 22 from the remote transmitter, a control signal is sent to the crank mechanism 50, which cranks the driveshaft 27 sufficient to move the cam over the top position. The force of spring 23 now acts to propel the throwing arm 20 forward rather than hold it back against the one-way bearing. The one-way bearing releases the throwing arm 20 to launch the target. The throwing arm 20 continues to rotate until the spring 23 once again expands and slows the throwing arm 20, which is then locked by the one-way bearing and the process is restarted to prepare for the next launch.

The throwing arm 20 is connected to the driveshaft 27 at pivot point 24, so that it may rotate a full 360 degrees to define a generally vertically oriented circle around the pivot point 24. At the distal end of throwing arm 20, is throwing element 28, which may be slightly curved to closely conform to the shape of the targets. In the "ready to fire" position, throwing arm 20 is oriented downwards and throwing element 28 is adjacent to a launching position 31 for receiving targets from the target delivery system 40.

Throwing guide 30, which functions as guide and direction device to keep the targets on the throwing element until released, is also directly connected to main support frame 11, and consists of a ramp whose inner surface 32 defines a portion of a circle of which pivot point 24 is the center, and the distance from pivot point 24 to the distal end of throwing arm 20 is the radius. The throwing guide starts at launching position 31, directly below pivot point 24, and extends to launch point 33. Launch point 33 may be located at up to approximately 90 to 120 degrees of rotation from launching position 31, however, the location of launch point 33 may be adjusted as desired for controlling the flight of the targets. Inner surface 32 of throwing guide 30 may be made of a low friction material such as the material used for construction of the skis and snowboards.

Throwing guide 30 is supported by sidewalls 34*a* (see FIG. 1) and 34*b* (see FIG. 2). Extending from sidewall 34*b* is support rail 35, which consists of a rod and completes the circle defined by the throwing guide. Support rail 35 is connected at its other end to main support frame 11.

A delivery system 40 is located adjacent launching position 31 and rests on a delivery system support frame 12. In the embodiment shown in FIGS. 1 to 5, delivery system 40 comprises a carousel, including a main hub 45, a plurality of spokes 62 arranged radially with respect to main hub 45, a loading mechanism 70, the details of which shall be discussed below, and a retaining ring 65.

Main hub 45 is rotatably connected to a main shaft (not shown), which is driven by loading mechanism 70, as described below. The spokes 62 are all of the same length, and extend toward the retaining ring 65, which describes a circle, the center of which corresponds to main hub 45. One active spoke 60 is lined up with launch position 31. Retaining ring 65 does not define a complete circle, but has an open portion in the area of active spoke 60. During operation, retaining ring 65 helps to maintain targets loaded onto the plurality of spokes 62 in place on the spokes.

Figure 3:
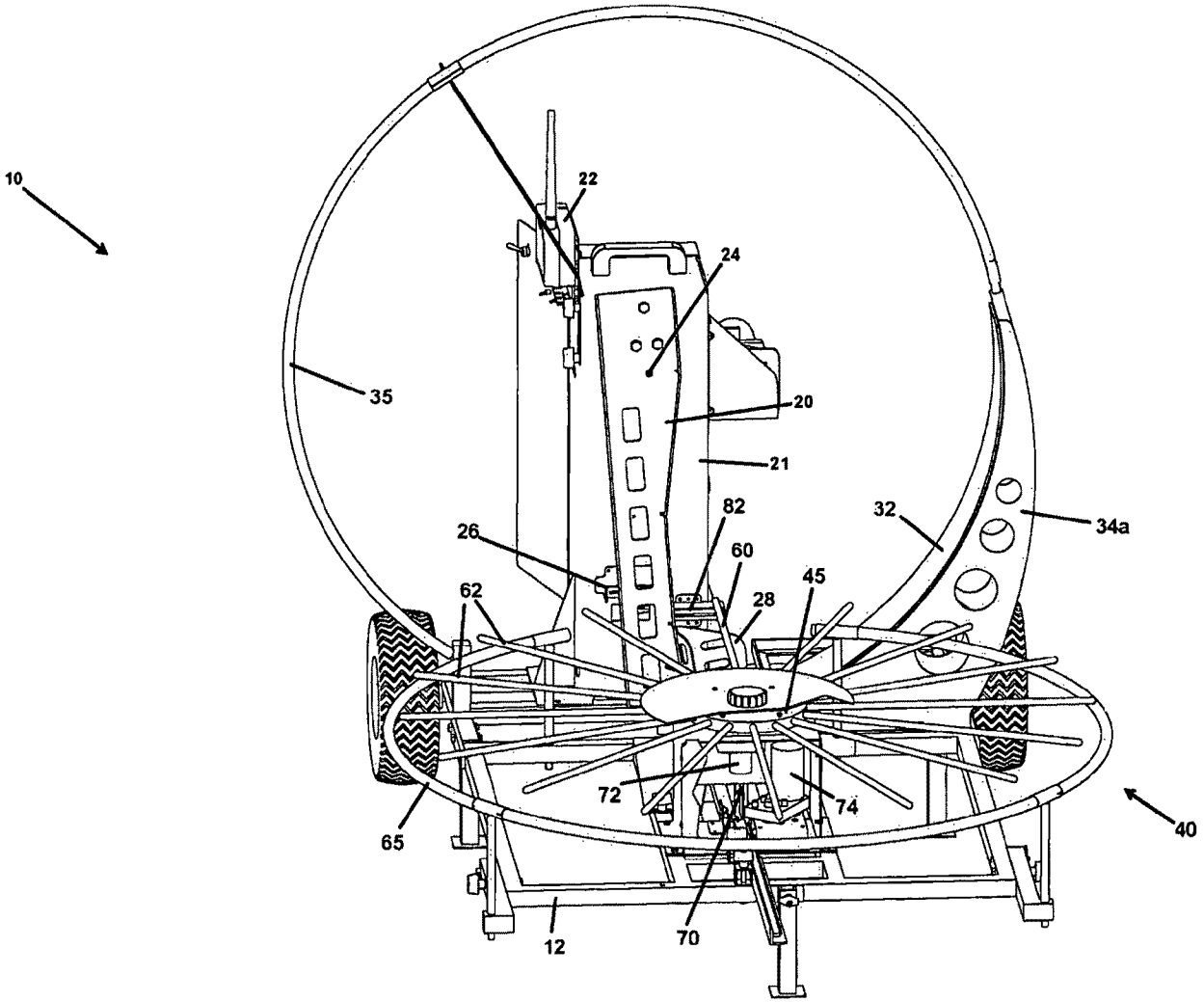
FIG. 3 is a front perspective, partial cut-away view of the target launching system shown in FIG. 1.
Figure 4:
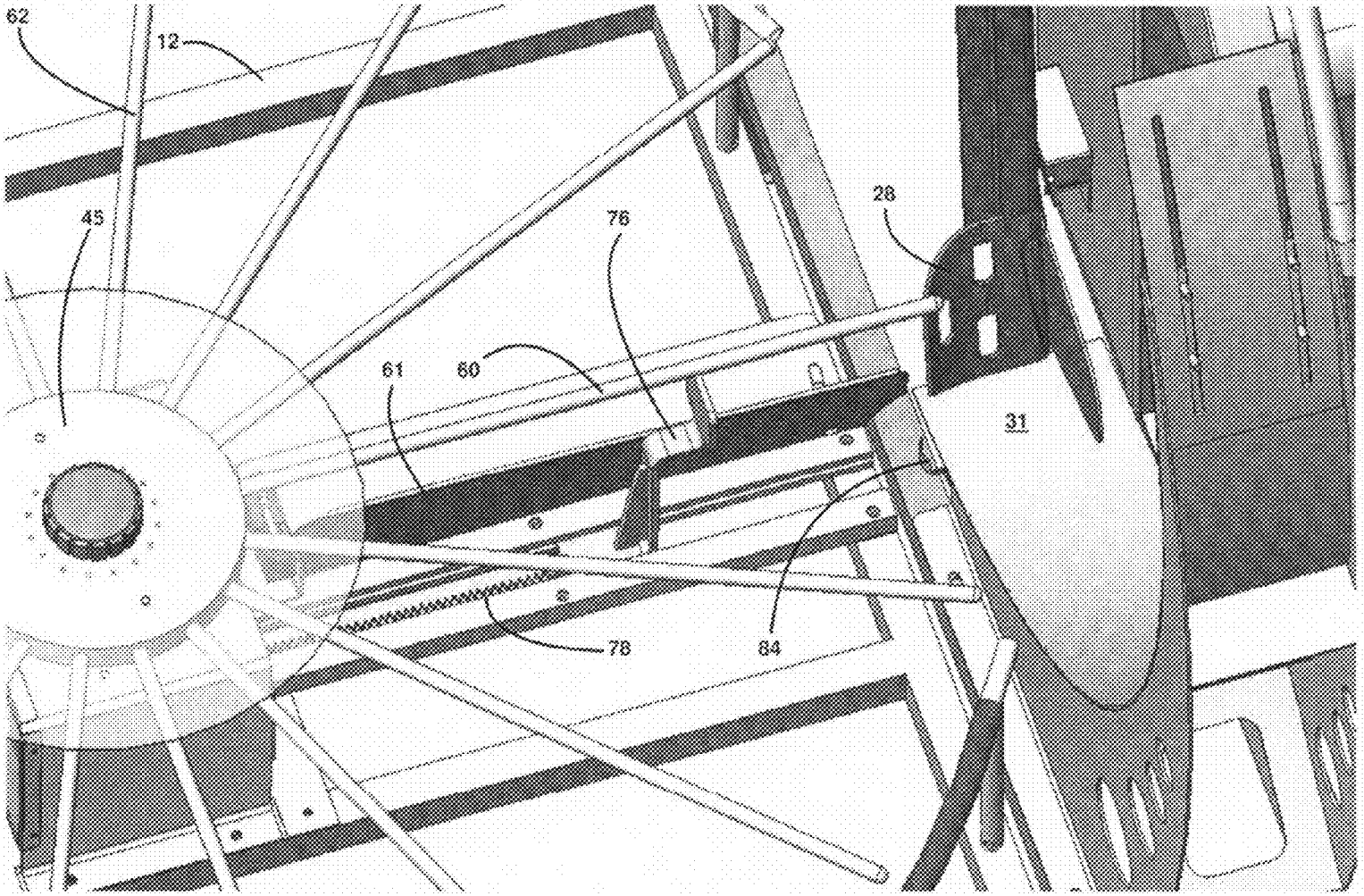
FIG. 4 is a close-up perspective partial view showing the launching position of the target launching system shown in FIG. 1.

Referring to FIGS. 3 and 4, the loading mechanism 70 includes a first drive motor 72 for rotation of the main hub 45 to thereby align spokes 62 with the launch position 31, and a second push motor 74 for moving push arm 76 along a push arm track 78. The push arm track 78 is aligned with the active spoke 60 so that as push arm 76 is moved incrementally along track 78, from an inner position closest to hub 45, to an outer position nearer to launch position 31. Targets held on active spoke 60 are successively moved into launching position 31 adjacent throwing element 28. A target guide plate 61 may be included along the edge of track 78 to assist in keeping the targets aligned on the active spoke 60 as they are moved into the launch position 31. Other methods of powering the main hub 45 and the push arm 76 are possible, such as a mechanical lever and gear system, solenoids, fluid activators, or the like.

The loading mechanism 70 includes a plurality of detection mechanisms or sensors for controlling movement of the push arm 76 and rotation of the main hub 45. In the present embodiment, the applicant uses electronic proximity switches, however, any well-known sensors could be used, such as micro switches.

Figure 5:
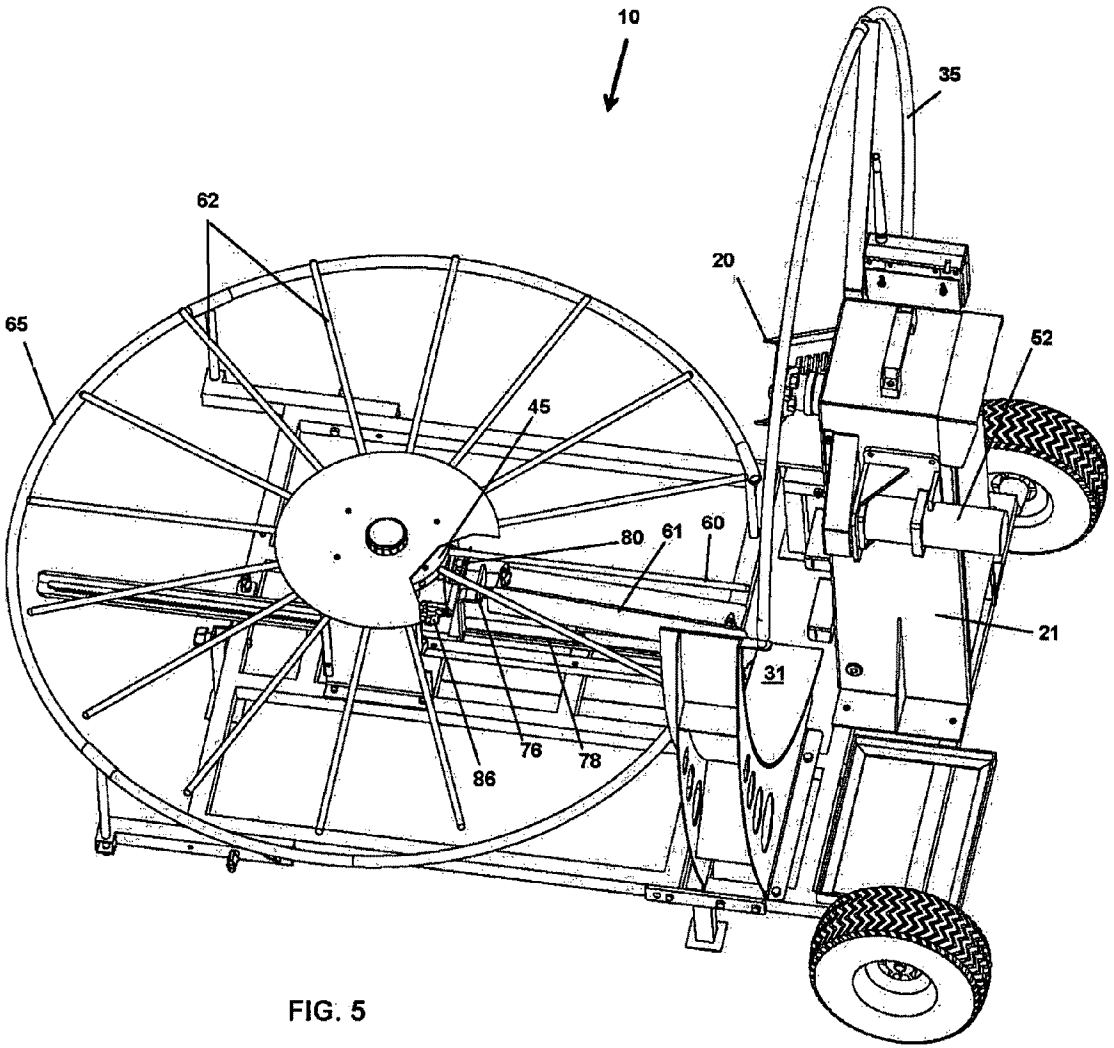
FIG. 5 is a left rear perspective, partial cut-away view of the target launching system shown in FIG. 1.

Referring to FIG. 5, a first proximity switch, position sensor 80, located near the base of main hub 45, is used to detect when the active spoke 60 is lined up with the target guide plate 61, and therefore launching position 31, and to stop rotation of the main hub 45. A second proximity switch, load sensor 82 (see FIG. 3), located on housing 21, is used to detect if there is a target on the throwing element 28 in launching position 31. If there is no target in the launching position 31, push arm motor 74 is activated to cause push arm 76 to move a target into the launching position 31. If there is a target located in launching position 31, push motor 74 is stopped or reversed. A third proximity switch, return sensor 84 (see FIG. 4), is used to detect when push arm 76 reaches its outer-most position along push arm track 78 adjacent to launching position 31, thereby having deposited the last of the targets into the launching position. Once push arm 76 reaches this outer-most position, push motor 74 is activated to move push arm 76 back to its inner-most position closest to main hub 45. A fourth proximity sensor, push arm stop sensor 86, is located near main hub 45 to stop push arm motor 74, when push arm 76 reaches its inner-most position. The main hub 45 is then rotated to bring the next spoke 62 into the active spoke position 60.

Figure 6:
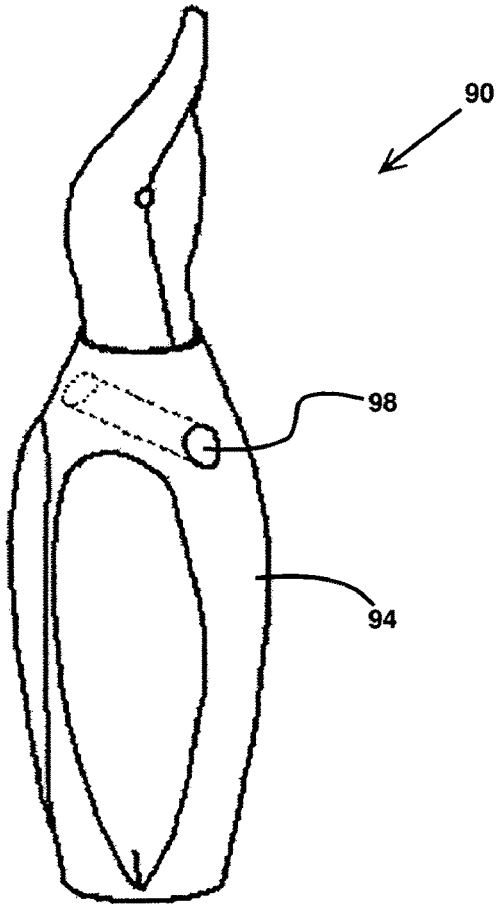
FIG. 6 shows a retrieval device that can be launched with the applicant's launching system.
Figure 7:
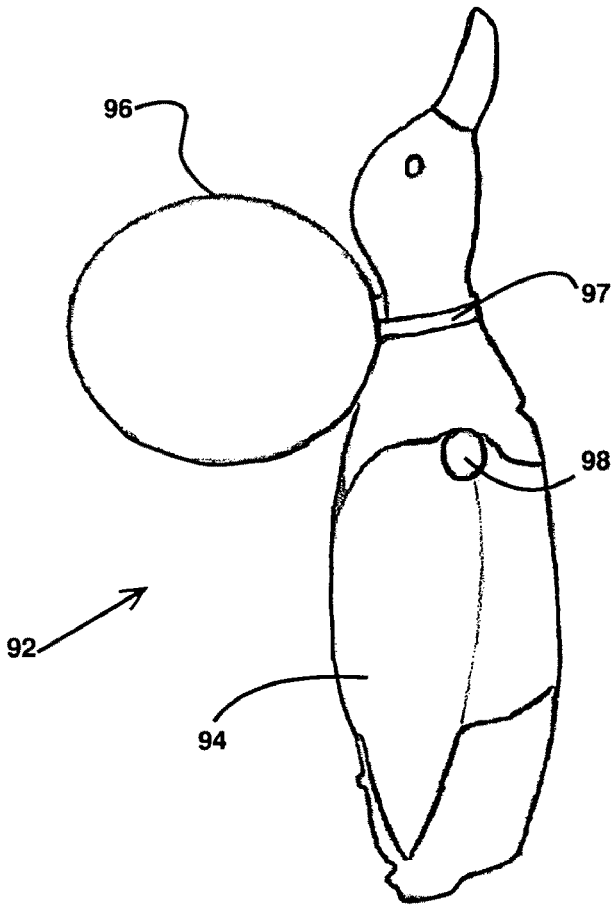
FIG. 7 shows a combination target retrieval device that can be launched with the applicant's launching system.

Referring to FIGS. 6 and 7, the applicant has found that the present launching system described herein is advantageous for launching irregularly shaped targets, retrieval devices 90 (shown in FIG. 6) and combination target and retrieval devices 92 (shown in FIG. 7), as previously mentioned above. Combination target and retrieval device 92 includes an irregular shaped body 94 and a target balloon 96 secured to the body with a clamp 97. To secure and provide proper and consistent alignment of these target devices 90, 92 on spokes 62, the target devices may be provided with an alignment hole 98 extending through a portion of the target devices. The target is held on the spoke by running the spoke through the alignment hole 98. To prevent the targets from spinning around on the spokes, the alignment holes and the spokes may be formed in a non-round, irregular shape, such as an oval or a square, or some other non-round shape to prevent rotation of the targets around the axis of the spokes. If round holes and spokes are used, the target guide plate 61 (as shown in FIGS. 1 and 4) will limit any unwanted rotation of the targets on the spokes. The spokes 62 and/or the alignment holes 98 may be coated with low friction material, such as mentioned above, to allow the targets to slide easily on the spokes. Retaining ring 65 keeps the targets from sliding off the spokes 62 when the spokes are not in the active position 60.

Other methods of fastening the targets to the spokes may be used, such as a hook, a clip or an eyelet fixed to the exterior of the target. However, by using a hole through the target, the applicant has found that the targets can be made to a more uniform shape, which allows for better manageability in loading and launching the target.

Those skilled in the art will appreciate that one of the advantages of the present launching system is the ability to hold multiple targets on multiple spokes 62 radiating outward from the main hub 45. However, the reader will also appreciate that a single spoke, which is sufficiently long to be able to hold multiple targets, could be used. In that case, the single spoke would be the active spoke 60 and there would be no need for a first drive motor 72 to rotate the main hub 45 for aligning the spokes or a first proximity switch, position sensor 80, for detecting when the active spoke 60 is in the correct position.

The previous detailed description is provided to enable any person skilled in the art to make or use the present launching system. Various modifications to those embodiments will be readily apparent to those skilled in the art, and the generic principles defined herein may be applied to other embodiments without departing from the spirit or scope of the launching system described herein. Thus, the present launching system is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

I claim:

1. A launching system for launching targets, the launching system comprising:

a delivery system for delivering the targets to a launching position, said delivery system comprising:

a plurality of spokes, each of said spokes holding a plurality of the targets; and a loading mechanism placing at least one of the targets into said launching position; and a throwing arm that throws said at least one target from said launching position.

2. The launching system of claim 1, further including a throwing guide to keep said at least one target engaged with said throwing arm until said at least one target reaches a desired launch point.

3. The launching system of claim 1, wherein said delivery system further comprises:

a sensor for detecting when each of said spokes does not hold any of said targets.

4. The launching system of claim 1, wherein said loading mechanism includes a push arm.

5. The launching system of claim 4, wherein said delivery system further comprises:

a sensor for detecting when each of said spokes does not hold any of said targets.

6. The launching system of claim 5, wherein said sensor comprises:

a switch activated by said push arm when each of said spokes does not hold any of said targets.

7. The launching system of claim 1, wherein said throwing arm comprises:

a proximate end rotatably connected at a pivot point; and a distal end, alignable with said launching position, wherein said distal end of said throwing arm closely fits the shape of the targets.

8. The launching system of claim 7, wherein said throwing arm is powered by a spring, causing said throwing arm to be rotated around said pivot point, thereby launching said at least one target.

9. The launching system of claim 7, wherein said distal end of said throwing arm defines a generally vertically oriented circle when rotating around said pivot point.

10. The launching system of claim 9, wherein said launching position is located approximately at the lowermost point of said vertically oriented circle.

11. The launching system of claim 10, including a throwing guide for keeping said at least one target engaged with said throwing arm until said at least one target reaches a desired launch point, wherein said throwing guide comprises:

an inner surface aligned with a portion of said vertically oriented circle.

12. The launching system of claim 11, wherein said inner surface of said throwing guide is made of a low friction material.

13. The launching system of claim 11, wherein said inner surface of said throwing guide defines less than approximately 120 degrees of the circumference of said vertically oriented circle.

14. The launching system of claim 1, wherein said spokes are coated with a low friction material.

15. The launching system of claim 1, wherein said targets are irregularly shaped.

16. The launching system of claim 1, wherein the targets have alignment means for holding and aligning the targets on said at least one spoke.

17. The launching system of claim 16, wherein said alignment means comprise:

an alignment hole extending through a portion of the targets, whereby the targets may be held on said at least one spoke by running said at least one spoke through said alignment hole.

18. The launching system of claim 17, wherein a cross-section of said alignment hole of said targets is a non-round shape.

19. The launching system of claim 1, wherein said plurality of spokes radiate outward from a central hub.

20. The launching system of claim 19, further including an alignment means for aligning a selected one of said spokes with said launching position.

21. The launching system of claim 20, wherein said alignment means comprises a means for rotating said hub.

22. The launching system of claim 21, wherein said alignment means is activated when said selected one of said spokes does not hold any of said targets.

23. The launching system of claim 1, whereby the targets comprise one of a target device, a retrieval device or a combination target and retrieval device.

24. A method of launching targets comprising the steps of:

providing a launching system for launching the targets, said launching system comprising:

a delivery system for delivering the targets to a launching position, said delivery system comprising:

a plurality of spokes, each of said spokes holding a plurality of the targets; and a loading mechanism placing at least one of the targets into said launching position; and a throwing arm that throws said at least one target from said launching position;

activating said delivery system, thereby causing said at least one target to be moved into said launching position; and activating said throwing arm, thereby causing said at least one target to be launched.

25. A launching system for launching targets, the launching system comprising:

a delivery system for delivering the targets to a launching position, said delivery system comprising:

a plurality of spokes holding a plurality of the targets; and a target loading mechanism including a powered drive mechanism that moves the targets into an outer loading position of the one of the plurality of spokes adjacent said launching position, and that moves at least one of the targets into said launching position; and a throwing arm that throws said at least one target from said launching position.

26. The launching system of claim 25, wherein said drive mechanism comprises a push motor and a push arm for pushing the targets into the outer loading position and then into the launching position.

* * * * *